US008353787B2

(12) United States Patent
Meyer et al.

(10) Patent No.: US 8,353,787 B2
(45) Date of Patent: Jan. 15, 2013

(54) GOLF CLUB HEAD WITH PROGRESSIVE FACE STIFFNESS

(75) Inventors: Jeffrey W. Meyer, Fallbrook, CA (US); Christopher D. Harvell, Escondido, CA (US); Stephen S. Murphy, Carlsbad, CA (US); Douglas C. Jorgensen, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/633,960

(22) Filed: Dec. 9, 2009

(65) Prior Publication Data

US 2010/0151963 A1 Jun. 17, 2010

Related U.S. Application Data

(60) Division of application No. 11/192,112, filed on Jul. 29, 2005, now Pat. No. 7,651,412, which is a continuation-in-part of application No. 10/662,682, filed on Sep. 15, 2003, now abandoned.

(51) Int. Cl.
*A63B 53/04* (2006.01)

(52) U.S. Cl. ..... 473/346

(58) Field of Classification Search ..... 473/324–350
See application file for complete search history.

(56) References Cited

U.S. PATENT DOCUMENTS

| | | | | |
|---|---|---|---|---|
| 1,526,438 | A * | 2/1925 | Scott | 473/305 |
| 1,582,836 | A * | 4/1926 | Link | 473/346 |
| 1,780,625 | A | 11/1930 | Mattern | 473/345 |
| 4,432,549 | A | 2/1984 | Zebelean | 473/346 |
| 4,511,145 | A * | 4/1985 | Schmidt | 473/346 |
| 4,762,322 | A | 8/1988 | Molitor et al. | 473/345 |
| 5,067,715 | A | 11/1991 | Schmidt et al. | 473/332 |
| 5,094,457 | A | 3/1992 | Kinoshita | 473/314 |
| 5,163,682 | A | 11/1992 | Schmidt et al. | 473/332 |
| 5,180,166 | A | 1/1993 | Schmidt et al. | 473/332 |
| 5,213,328 | A * | 5/1993 | Long et al. | 473/346 |
| 5,240,252 | A | 8/1993 | Schmidt et al. | 473/327 |
| 5,271,620 | A | 12/1993 | Moriguchi et al. | 473/324 |
| 5,295,689 | A * | 3/1994 | Lundberg | 473/346 |
| 5,301,945 | A | 4/1994 | Schmidt et al. | 473/311 |
| 5,318,300 | A | 6/1994 | Schmidt et al. | 473/305 |

(Continued)

FOREIGN PATENT DOCUMENTS

JP 04347179 A * 12/1992

(Continued)

OTHER PUBLICATIONS

Non-Final Office Action dated Jun. 4, 2007 of corresponding U.S. Appl. No. 11/192,112.

(Continued)

*Primary Examiner* — Alvin Hunter
(74) *Attorney, Agent, or Firm* — Murphy & King, P.C.

(57) ABSTRACT

A metal wood golf club head adapted for attachment to a shaft, with a body comprising of a first body portion and a second body portion, each portion constructed of a different density material. Combining a high density material in the first body portion with a low density material in the second body portion, creates an ultra-low center of gravity relative to the geometric face center, resulting in higher launch angles and spin rate ratios. Thickening the lower area of the front face lowers the center of gravity and upwardly shifts the coefficient of restitution to the geometric center of the face.

22 Claims, 14 Drawing Sheets

U.S. PATENT DOCUMENTS

| | | | | | |
|---|---|---|---|---|---|
| 5,328,176 | A | | 7/1994 | Lo | 273/167 H |
| 5,354,054 | A | | 10/1994 | Akatsuka et al. | 473/289 |
| 5,380,010 | A | * | 1/1995 | Werner et al. | 473/346 |
| 5,397,127 | A | | 3/1995 | Kawada et al. | 473/324 |
| 5,410,798 | A | | 5/1995 | Lo et al. | 29/527 |
| 5,419,559 | A | | 5/1995 | Melanson et al. | 473/346 |
| 5,429,365 | A | * | 7/1995 | McKeighen | 473/346 |
| 5,460,376 | A | | 10/1995 | Schmidt et al. | 473/328 |
| 5,470,069 | A | | 11/1995 | Schmidt et al. | 473/311 |
| 5,471,383 | A | | 11/1995 | Gobush et al. | 364/410 |
| 5,474,296 | A | | 12/1995 | Schmidt et al. | 473/346 |
| 5,480,152 | A | | 1/1996 | Schmidt et al. | 473/291 |
| 5,494,281 | A | | 2/1996 | Chen | 473/329 |
| 5,586,948 | A | * | 12/1996 | Mick | 473/332 |
| 5,595,552 | A | | 1/1997 | Wright et al. | 473/332 |
| 5,611,741 | A | | 3/1997 | Schmidt et al. | 473/328 |
| 5,611,742 | A | | 3/1997 | Kobayashi | 473/345 |
| 5,624,331 | A | | 4/1997 | Lo et al. | 473/345 |
| 5,643,099 | A | | 7/1997 | Solheim | 473/238 |
| 5,643,111 | A | * | 7/1997 | Igarashi | 473/332 |
| 5,695,411 | A | | 12/1997 | Wright et al. | 473/332 |
| 5,697,853 | A | | 12/1997 | Schmidt et al. | 473/328 |
| 5,697,854 | A | | 12/1997 | Aizawa et al. | 473/344 |
| 5,711,722 | A | * | 1/1998 | Miyajima et al. | 473/346 |
| 5,718,641 | A | * | 2/1998 | Lin | 473/224 |
| 5,803,823 | A | | 9/1998 | Gobush et al. | 473/223 |
| 5,836,830 | A | | 11/1998 | Onuki et al. | 473/349 |
| 5,851,160 | A | | 12/1998 | Rugge et al. | 473/349 |
| 5,908,356 | A | * | 6/1999 | Nagamoto | 473/224 |
| 5,941,782 | A | * | 8/1999 | Cook | 473/346 |
| 6,010,411 | A | | 1/2000 | Reyes | 473/345 |
| 6,027,416 | A | | 2/2000 | Schmidt et al. | 473/345 |
| 6,203,449 | B1 | * | 3/2001 | Kenmi | 473/346 |
| 6,241,622 | B1 | | 6/2001 | Gobush et al. | 473/199 |
| 6,254,494 | B1 | | 7/2001 | Hasebe et al. | 473/349 |
| 6,267,691 | B1 | * | 7/2001 | Dammen | 473/329 |
| 6,285,445 | B1 | | 9/2001 | Winfield et al. | 356/28 |
| 6,309,311 | B1 | * | 10/2001 | Lu | 473/332 |
| 6,315,678 | B1 | | 11/2001 | Teramoto | 473/291 |
| 6,319,150 | B1 | | 11/2001 | Werner et al. | 473/349 |
| 6,340,337 | B2 | | 1/2002 | Hasebe et al. | 473/349 |
| 6,354,963 | B1 | | 3/2002 | Kodama et al. | 473/345 |
| 6,386,990 | B1 | | 5/2002 | Reyes et al. | 473/344 |
| 6,440,008 | B2 | | 8/2002 | Murphy et al. | 473/324 |
| 6,478,692 | B2 | | 11/2002 | Kosmatka | 473/342 |
| 6,488,591 | B1 | | 12/2002 | Gobush et al. | 473/199 |
| 6,491,592 | B2 | | 12/2002 | Cackett et al. | 473/342 |
| 6,500,073 | B1 | | 12/2002 | Gobush et al. | 473/199 |
| 6,533,674 | B1 | | 3/2003 | Gobush | 473/199 |
| 6,572,491 | B2 | | 6/2003 | Hasebe et al. | 473/349 |
| 6,575,845 | B2 | | 6/2003 | Galloway et al. | 473/329 |
| 6,582,323 | B2 | | 6/2003 | Soracco et al. | 473/342 |
| 6,612,938 | B2 | | 9/2003 | Murphy et al. | 473/324 |
| 6,776,723 | B2 | | 8/2004 | Bliss et al. | 473/291 |
| 7,059,973 | B2 | * | 6/2006 | Erickson et al. | 473/345 |
| 7,066,835 | B2 | * | 6/2006 | Evans et al. | 473/346 |
| 7,651,412 | B2 | * | 1/2010 | Meyer et al. | 473/342 |
| 2003/0083151 | A1 | | 5/2003 | Nakahara et al. | |
| 2003/0100381 | A1 | | 5/2003 | Murphy et al. | |
| 2003/0134692 | A1 | | 7/2003 | Nakahara et al. | |
| 2005/0059508 | A1 | | 3/2005 | Burnett et al. | |
| 2006/0217215 | A1 | * | 9/2006 | Erickson et al. | 473/342 |

FOREIGN PATENT DOCUMENTS

| | | | | |
|---|---|---|---|---|
| JP | 06182005 | | | 7/1994 |
| JP | 08243194 | | | 9/1996 |
| JP | 08280853 | | | 10/1996 |
| JP | 08280853 | A | * | 10/1996 |
| JP | 09294833 | A | * | 11/1997 |
| JP | 10024130 | A | * | 1/1998 |
| JP | 11028260 | A | * | 2/1999 |
| JP | 11347158 | | | 12/1999 |
| JP | 2000317018 | | | 11/2000 |
| JP | 2000317018 | A | * | 11/2000 |
| JP | 2001029521 | A | * | 2/2001 |
| JP | 2003290396 | A | * | 10/2003 |
| JP | 2003339921 | A | * | 12/2003 |
| JP | 2004313354 | A | * | 11/2004 |
| JP | 2004329544 | A | * | 11/2004 |
| JP | 2005168665 | A | * | 6/2005 |
| JP | 2006051366 | A | * | 2/2006 |

OTHER PUBLICATIONS

Final Office Action dated Dec. 26, 2007 of corresponding U.S. Appl. No. 11/192,112.

Non-Final Office Action dated Jun. 4, 2008 of corresponding U.S. Appl. No. 11/192,112.

Final Office Action dated Nov. 5, 2008 of corresponding U.S. Appl. No. 11/192,112.

Advisory Action dated Jan. 15, 2009 of corresponding U.S. Appl. No. 11/192,112.

Advisory Action dated Feb. 25, 2009 of corresponding U.S. Appl. No. 11/192,112.

Non-Final Office Action dated Mar. 30, 2009 of corresponding U.S. Appl. No. 11/192,112.

Non-Final Office Action dated Nov. 12, 2004 of corresponding U.S. Appl. No. 10/662,682.

Non-Final Office Action dated May 11, 2005 of corresponding U.S. Appl. No. 10/662,682.

Final Office Action dated Dec. 23, 2005 of corresponding U.S. Appl. No. 10/662,682.

Non-Final Office Action dated Apr. 17, 2006 of corresponding U.S. Appl. No. 10/662,682.

Final Office Action dated May 12, 2006 of corresponding U.S. Appl. No. 10/662,682.

Advisory Action dated Aug. 14, 2006 of corresponding U.S. Appl. No. 10/662,682.

Jackson, Jeff. The Modern Guide to Golf Clubmaking. Ohio: Dynacraft Golf Products, Inc. copyright 1994, p. 237.

Mizuno USA, Model MP-001 Driver, Aug. 2003 GolfWorld and Mizuno Website wwwmizunousa.com.

Callister, Jr., William, Materials Science and Engneering. New York: John Wiley & Sons, Inc. copyright 1997, p. 775.

USGA Procedure for Measuring the Velocity Ration of a Club Head for Conformance to Rule 4-le, Appendix II. Revision I, Aug. 4, 1998 and Revision 0, Jul. 6, 1998.

* cited by examiner

GOLF CLUB HEAD WITH PROGRESSIVE FACE STIFFNESS

CROSS-REFERENCE TO RELATED APPLICATIONS

This application is a divisional of U.S. patent application Ser. No. 11/192,112, filed Jul. 29, 2005, now U.S. Pat. No. 7,651,412, which is a continuation-in-part of U.S. patent application Ser. No. 10/662,682 filed on Sep. 15, 2003, now abandoned, which is incorporated herein by reference in its entirety.

BACKGROUND OF THE INVENTION

1. Field of the Invention

The present invention relates to a multi-material, multi-component metal wood golf club head.

2. Description of the Related Art

Golf clubs have achieved a remarkable transformation from persimmon wood clubs to the present day metal woods with their extremely large head sizes. This has been made possible by high strength metallic materials, which allow the golf ball to be hit farther and straighter because of increased club head inertia and coefficient of restitution.

Particularly, development of titanium alloys, which are light (specific gravity: 4.5 to 5.0) and strong, have allowed significant increases in the head size and subsequent practical shaft length of a golf club. Specifically, a large moment of inertia, resulting in an increased area of high speed on the club face can be achieved by use of a large club head. Thus there is a constant demand for club heads of greater size. However, enlarging the club head also increases its weight. Most of the metal wood golf clubs manufactured today have a shell thickness so thin that they border on practical manufacturing limits. This has resulted in the search for materials that are even less dense than titanium. Golf club manufacturers are looking for solutions wherein lighter and stronger materials may be employed. And, in some cases, for materials that will partially replace titanium, which is relatively costly and requires considerable care in forming and casting.

Among the more prominent considerations in club head design are loft, lie, face angle, horizontal face bulge, vertical face roll, center of gravity, inertia, material selection, and overall head weight. While this basic set of criteria is generally the focus of golf club engineering, several other design aspects must also be addressed. The interior design of the club head may be made to achieve particular performance characteristics, such as with the inclusion of hosel or shaft attachment means, or the use of weight members.

The United States Golf Association (USGA), the governing body for the rules of golf in the United States, has specifications for the performance of golf clubs and golf balls. Golf clubs are limited to a Coefficient of Restitution (COR) of 0.83. One USGA rule limits the golf ball's initial velocity after a prescribed impact to 250 feet per second±2% (or 255 feet per second maximum initial velocity). To achieve greater golf ball travel distance, ball velocity after impact and the coefficient of restitution of the ball-club impact must be maximized while remaining within the rules.

SUMMARY OF THE INVENTION

The present invention relates to a multi-material, multi-component metal wood golf club head comprised of a front face having a geometric face center, wherein the center of gravity is at least 6 mm lower than the geometric face center, and the point of maximum Coefficient of Restitution (COR) is not lower than 2 mm below the geometric face center.

An embodiment of the invention, designated as club head, comprises a first body portion, a second body portion, and a hosel member. The first body portion 20 comprises a cup-like face section, a sole section, and a bore-thru hosel tube. The second body portion comprises at least a crown section and a substantial portion of a skirt section, and is of a lower density than the first body portion. The density of the second body portion may be between about 0.1 g/cc to 4.0 g/cc.

The material of construction for the first body portion may be a stainless steel alloy, but preferably is a titanium alloy. While magnesium is preferred for the second body portion, composite, or other lightweight metal such as aluminum, or a thermoplastic may be substituted for the magnesium, but with different performance characteristics. The third body portion is a hosel section formed from a lightweight metal or a thermoplastic, including nylon, composite or aluminum materials.

The club head of the present invention has a coefficient of restitution (COR) greater than 0.80, with a COR gradient created in the front face. The thickness of the face is preferably progressively greater in a direction from the crown section to the sole section. This is a beneficial design consideration, since the club head has a lowered center of gravity, the greater face thickness at the sole section refocuses the COR towards the center of the face.

The weight reduction, due to the use of lower density materials in the second body portion and hosel member, allows for that weight to be relocated in the club head. The present invention provides for a weight member, having a generally horseshoe shape, to be positioned on the inside surface of the sole section, at a point near the sole/skirt junction. This further lowers the club head center of gravity and moves it farther from the face, and preferably at least 12 mm from the centerline of the shaft axis.

Another embodiment of the invention utilizes only two body portions, the light weight second portion incorporating both the crown section and the hosel member.

In another aspect of the present invention, an insert is placed on the club face on a surface opposite the striking surface. The insert, which is light-weight and can be made of a variety of materials, stiffens the portion of the club face on and around the attachment location. This increased face stiffness lowers the coefficient of restitution of the affected area of the club face. As a result, the compliant area or "sweet spot" of the club head is shifted upward, preferably above the geometric center of the club face. Providing a face that is stiffer near the sole and progressively less stiff approaching the crown produces a higher launching, lower spinning trajectory of a struck golf ball, adding distance to the golf shot. The acoustics and feel of the golf club may also be improved. The insert may be a tapered patch, thicker near the sole than the crown, that is adhered or otherwise attached to the inner surface of the club face. The increased thickness of the insert near the sole imparts more stiffness to that portion of the club face, and a greater decrease in the local coefficient of restitution. The tapered form of the insert approaching the crown imparts less stiffness and results in a lesser decrease in the local coefficients of restitution. The insert may be provided as one or more ribs that can be oriented vertically, horizontally, or both on the club face. Again, the ribs are provided with more mass toward the sole and decreasing mass as the ribs approach the crown. Rather than having a face of varying thickness to produce a COR gradient, the insert allows the face to be of uniform thickness. This reduces the weight of the face, which weight the club head designer can apply elsewhere in locations that increase the forgiveness and playability of the resulting golf club.

DESCRIPTION OF THE DRAWINGS

The present invention is described with reference to the accompanying drawings, in which like reference characters reference like elements, and wherein.

DETAILED DESCRIPTION OF THE INVENTION

Figure 1:
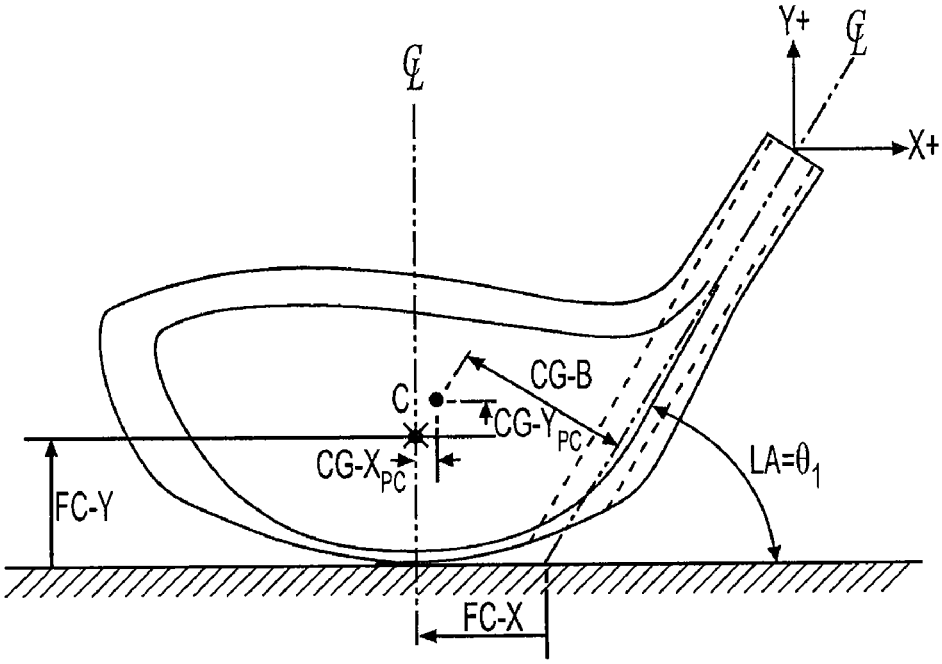
FIG. 1 is a front schematic of a golf club with the face square and the club head soled in the address position for depicting the face center and center of gravity based on test data.

The golf club head according to preferred embodiments of the present invention, is a multi-material and multi-component hollow club head.

As shown is FIGS. 3-8, a club head 30 is generally composed of three components, which includes a first body portion 31, a second body portion 32 and a hosel member 33. First body portion 31 is substantially comprised of: a cup-shaped front face section 37; a sole section 36 that includes a horseshoe shaped high density weight member 40 that is positioned on the inner surface of the sole section 36 at a predetermined distance from the front face section 37; and, a bore-thru-hosel tube 42. Second body portion 32 is of a lower density than the first body portion 31 and comprises at least a crown section 34, and a substantial portion of a skirt section 35. Hosel member 33 is also of a low density material having one end 45 for connection to a shaft (not shown) and the opposing end 46 for connection to the bore-thru-hosel tube 42.

The density range for second body portion 32 and hosel member 33, is from about 0.1 g/cc to 4.0 g/cc. Both may be formed from materials such as aluminum, graphite composite, a thermoplastic, but the preferred material for the second body portion 32 is magnesium, and the preferred material for the hosel member 33 is nylon. The method of manufacturing the portions 32 and 33, may be casting, injection molded, machining, prepreg sheet formed, and the like. Preferably, the second body portion 32 has a thickness in the range of about 0.5 mm to about 1.5 mm, and more preferably less than about 1.0 mm. An advantage of injection molding is that it may provide the second body portion 32 with a geometrically complex shape that includes the crown section 34 and a substantial part of the skirt section 35.

The materials for forming first body portion 31 may be stainless steel, pure titanium or a titanium alloy. The more preferred material comprises titanium alloys, such as titanium 6-4 alloy, which comprises 6% aluminum and 4% vanadium, or SP-700 titanium alloy, which comprises 4.7% aluminum, 2.9% vanadium, 2.0% molybdenum and 2.1% iron and is commercially available from NKK (Japan) and RTI International Metals (Niles, Ohio). First body portion 31 may be manufactured through casting with a face insert that is made by forming, or forging with a stamped sole, or forming a wrapped face with a stamped sole, or powdered metal forming, or metal-injection-molding and the like.

By using magnesium for the second body portion 32, a certain amount of weight may be reassigned to the weight member 40, which is integral with the sole section 36. The horseshoe shaped weight member 40 has a specified density in the range from about 4 g/cc to 20 g/cc, and may be selected from such materials as tungsten, molybdenum or another like metal in a like density range. Weight member 40 may be cast, injection molded, machined or formed by a powdered metal process. Weight member 40 is positioned away from the face section 37, a design concept that facilitates the lowering of the center of gravity C. The methods for determining the positioning of the center of gravity C and the calculation of the geometric face center X are shown on schematic FIGS. 1 and 2. Dimensions were measured with the club head face square and the club soled in the address position.

Three embodiments of the club head 30 design of the present invention were tested against a prior art club (Titleist® 983K driver) which is very similar in appearance, size and shape of the embodiments of the present invention. The three embodiments were all generally identical to each other except for the materials of construction of the second and third body portions 32, 33.

Test results for determining the position of the center of gravity C as it relates to the geometric face center are presented below in Table I, for three different embodiments of the present invention. Test data is also presented for the prior art club head Titleist® 983K, for comparison purposes.

TABLE I (Club Head Mass Properties)

Figure 2:
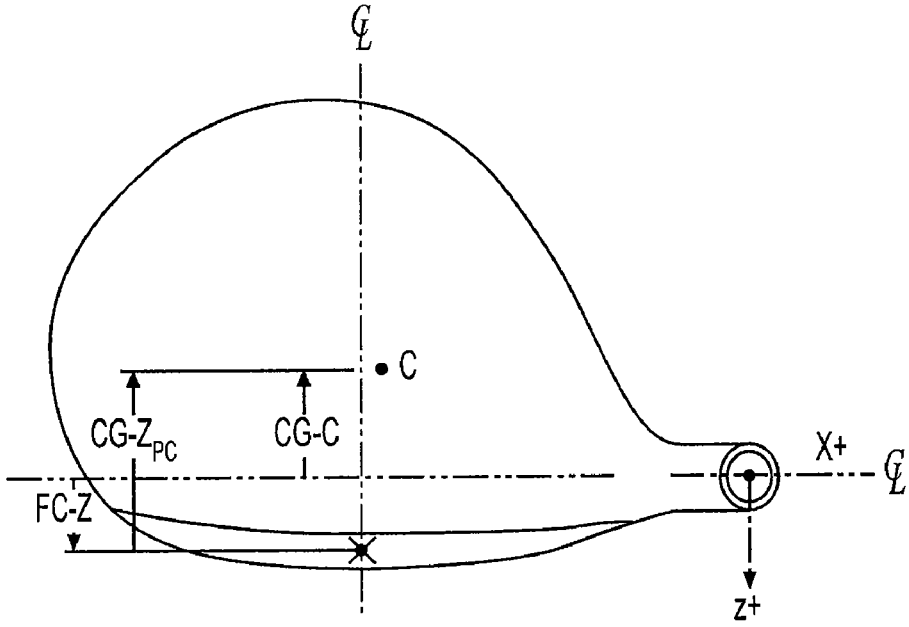
FIG. 2 is a top schematic of FIG. 1.
Figure 3:
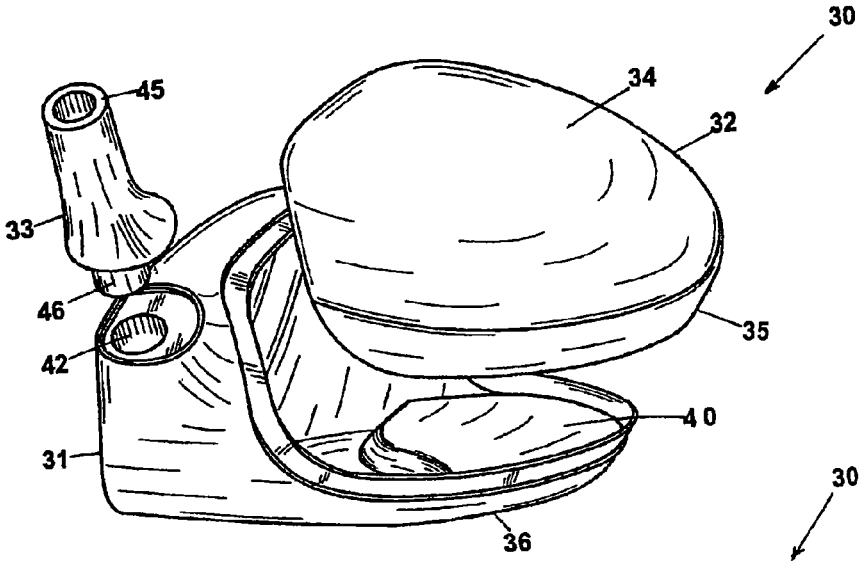
FIG. 3 is an expanded pictorial view of an embodiment of the invention, having three body portions.
Figure 4:
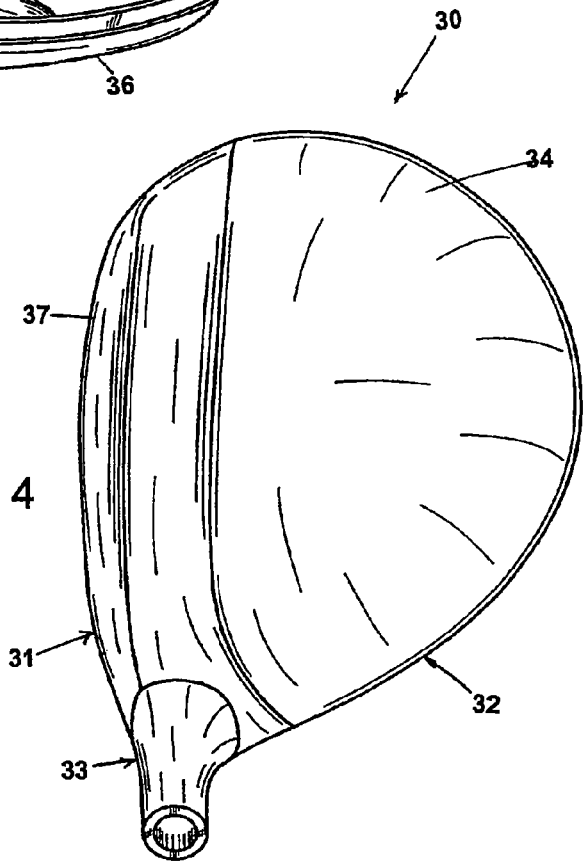
FIG. 4 is a top view of FIG. 3 thereof.

| From FIGS. 1 & 2 | Titleist ® 983K (mm) | Embodiment A (mm) | Embodiment B (mm) | Embodiment C (mm) |
|---|---|---|---|---|
| CG-Xfc | 4.37 | −2.05 | −0.4 | −0.88 |
| CG-Yfc | 2.29 | −7.88 | −6.61 | −8.19 |
| CG-Zfc | 31.89 | 31.08 | 30.30 | 31.12 |
| CG-B | 35.76 | 31.44 | 32.30 | 31.34 |
| CG-C | −15.47 | −15.26 | −14.92 | −14.86 |
| FC-X | −27.79 | −21.18 | −23.27 | −22.59 |
| FC-Y | 27.29 | 29.85 | 29.46 | 29.59 |
| FC-Z | 16.42 | 15.82 | 15.38 | 16.27 |
| MOI IMPACTS | (kg-mm$^2$) | (kg-mm$^2$) | (kg-mm$^2$) | (kg-mm$^2$) |
| High-low - x | 231.2 | 217.6 | 225.2 | 218.9 |
| Heel-toe - y | 358.6 | 370.3 | 414.5 | 355.7 |
| Lofted - z | 351.3 | 255.4 | 293.0 | 251.9 |
| About shaft | 653.9 | 563.5 | 582.3 | 557.9 |

(a) Embodiment A comprises magnesium second body portion 32 and a nylon hosel member 33.
(b) Embodiment B comprises a composite second body portion 32 and an aluminum hosel member 33.
(c) Embodiment C comprises a composite second body portion 32 and a nylon hosel member 33.

Embodiment A of the present invention provides for a shift in the center of gravity C to a position at least 6 mm below the geometric face center X. The actual test results show the center of gravity C to be 7.88 mm below its geometric face center X, while tests for the Titleist® 983K (having a titanium crown and skirt) provided data indicating that the 983K's center of gravity was 2.29 mm above its 15 geometric face center. Comparable shifts in the center of gravity C are seen in the test data for embodiments B and C.

The Titleist® 983K has a volume of 363 cubic centimeters, and a titanium SP700 stamped hitting face with a thickness of about 0.122 inch. Unlike the present invention, the 983K does not have a thickness gradient in the hitting face 48 (discussed below). And, while the second body portion 32 of the present invention is formed from magnesium, and the hosel member 33 is formed of nylon, these portions of the 983K are formed from the heavier titanium alloys. Other than these differences, the embodiments of the present invention and the 983K are very comparable in size and dimension. Test results are shown in FIGS. 14-21.

Figure 14:
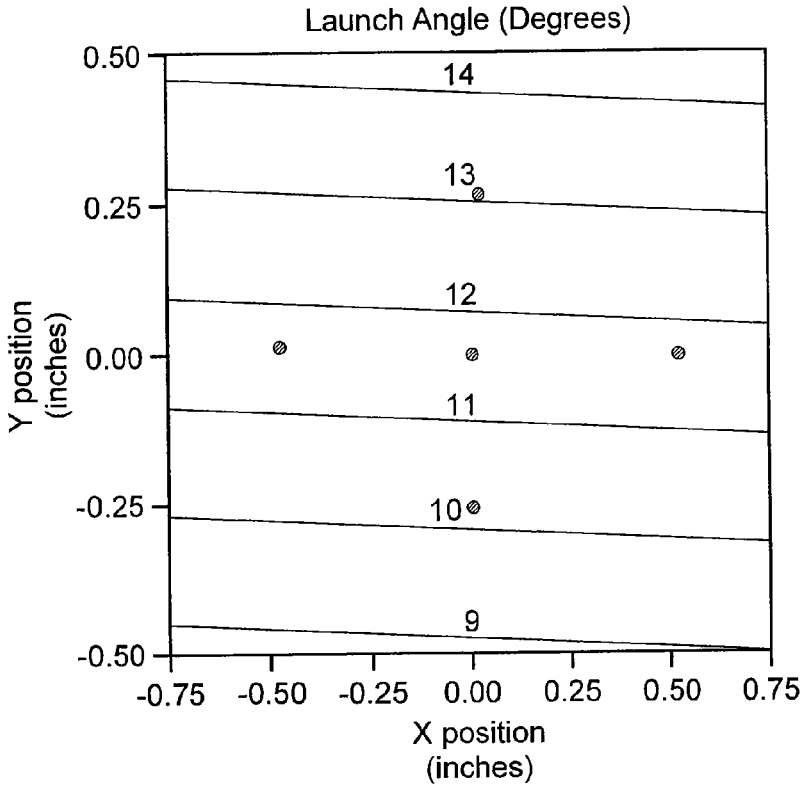
FIG. 14 (prior art)
FIG. 14 is a graph illustrating the relationship of launch angles to the face center for the prior art Titleist® 983K driver.
Figure 15:
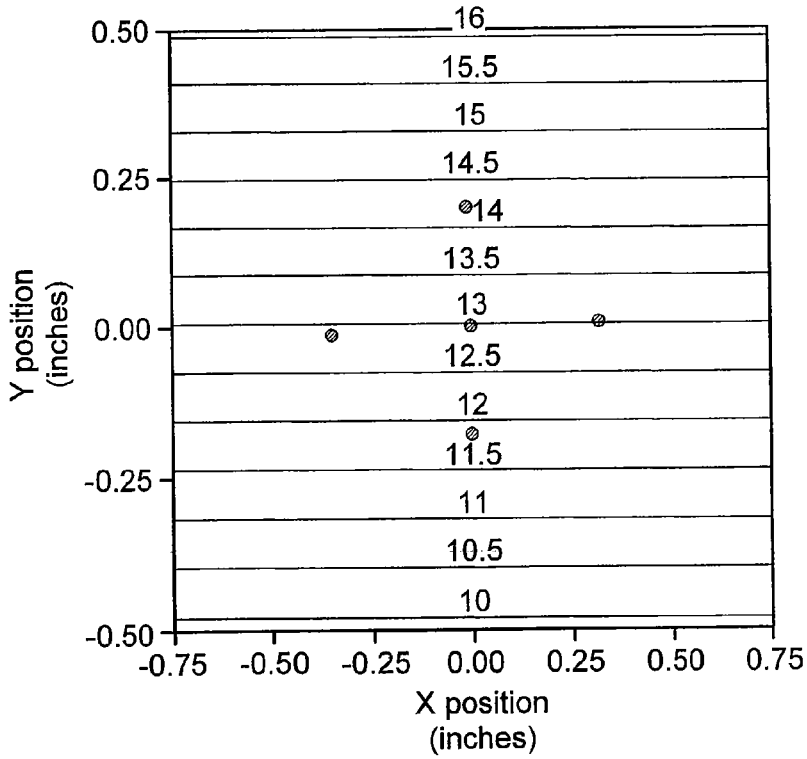
FIG. 15 is a graph illustrating the relationship of launch angles to the front face for the present invention.

FIGS. 14 and 15, depict data indicating launch angles of the prior art Titleist® 983K and Embodiment A (with the magnesium second body portion 32) respectively. The low center of gravity C, of Embodiment A, creates a launch angle of about 1.5° higher than that achieved with the prior art 983K club head (13° versus)11.5°.

Figure 16:
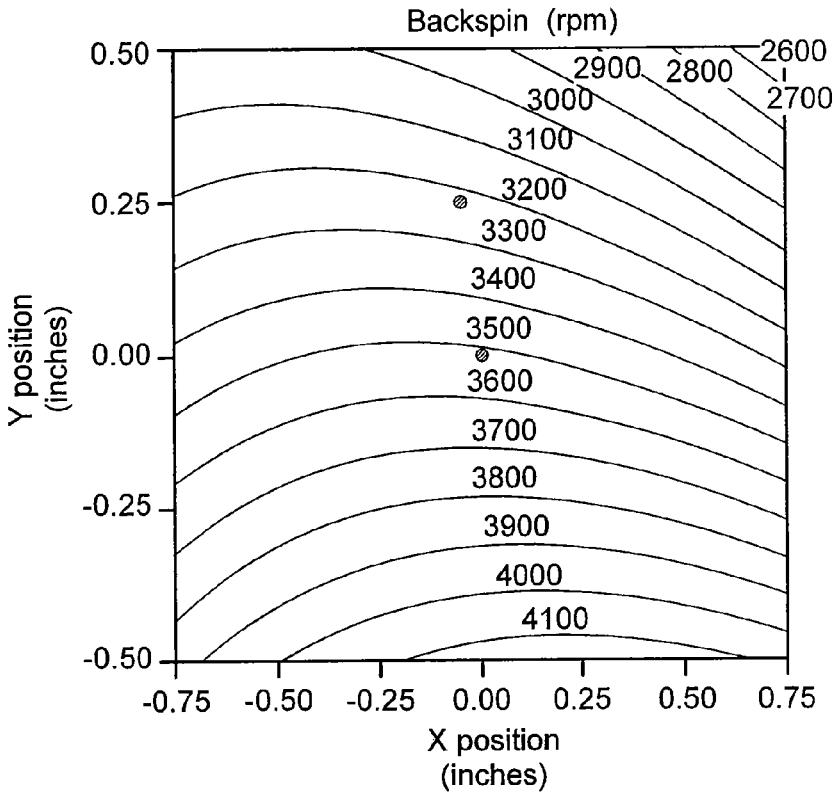
FIG. 16 (prior art)
FIG. 16 is a graph depicting the relationship of backspin to the front face for the prior art Titleist® 983 K.
Figure 17:
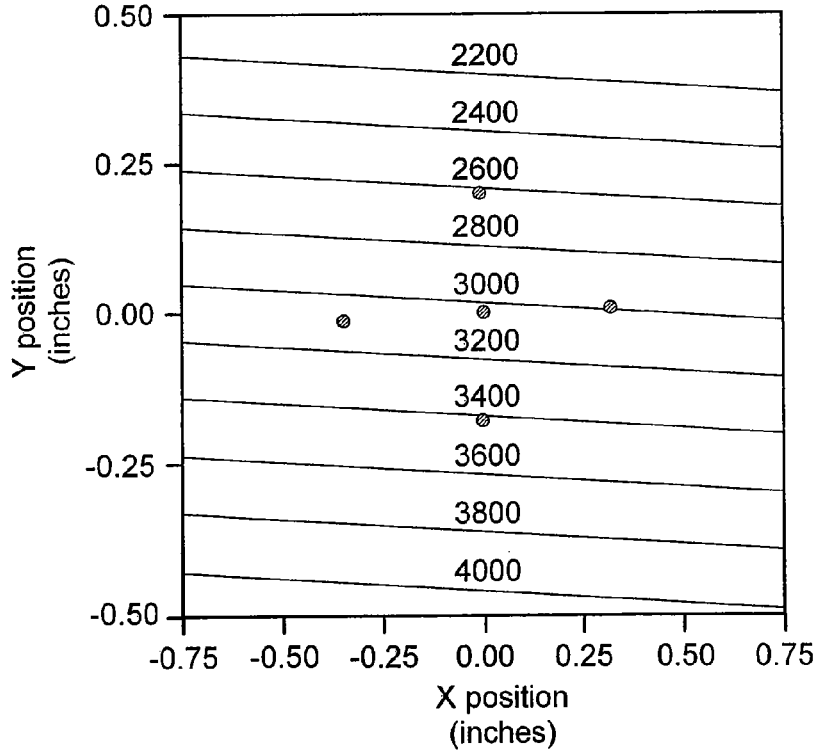
FIG. 17 is a graph depicting the relationship of backspin to the front face for the present invention.

FIG. 16 graphically details the spin rate performance of the prior art 983K club head versus the magnesium crown of Embodiment A, as shown in FIG. 17. At the geometric face center of each club head (shown as 0.00 on the X-Y coordinates), the present invention produces a backspin of almost 500 rpm lower than the prior art 983K.

Figure 18:
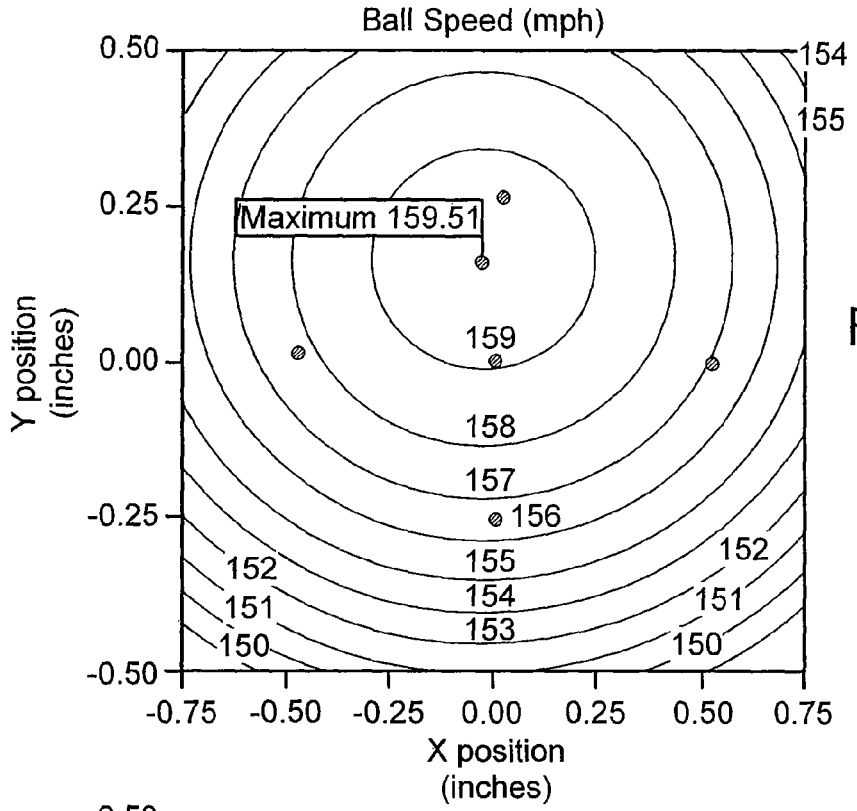
FIG. 18 (prior art)
FIG. 18 is a graph relating ball speed to front face for the prior art 983K.
Figure 19:
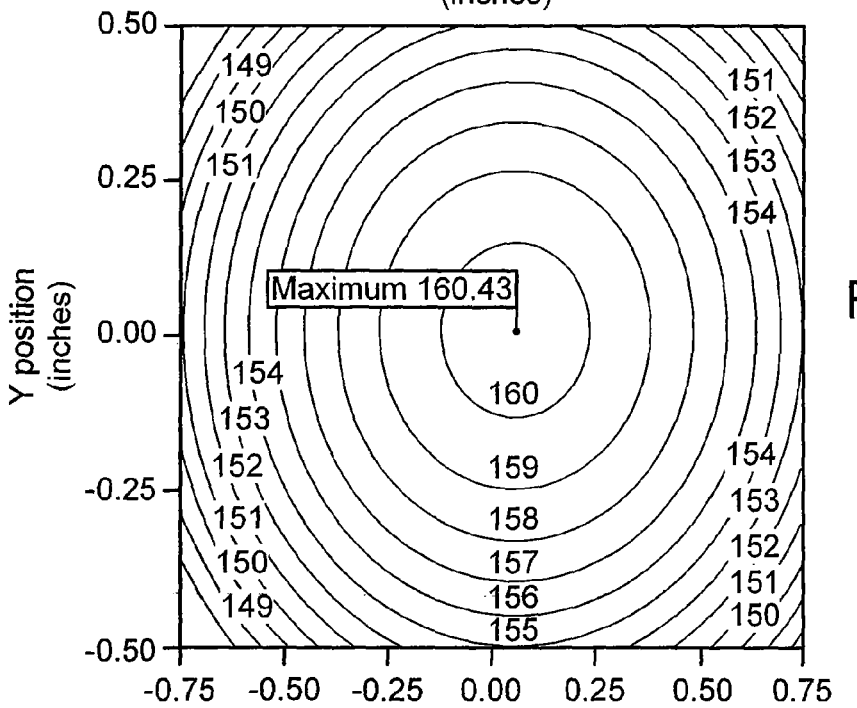
FIG. 19 is a graph relating ball speed to front face for the present invention.

A significant improvement in ball speed of the present invention over the prior art 983K can be best described by FIGS. 18 and 19. The maximum ball speed of the prior art club head is achieved at a position about 0.20 inches above the geometric face center (FIG. 18) while the maximum ball speed of the magnesium crown present invention is maintained at about the geometric center or lower. This point of maximum ball speed is the point of maximum coefficient of restitution, which is often referred to by golfers as the "sweet spot."

Figure 20:
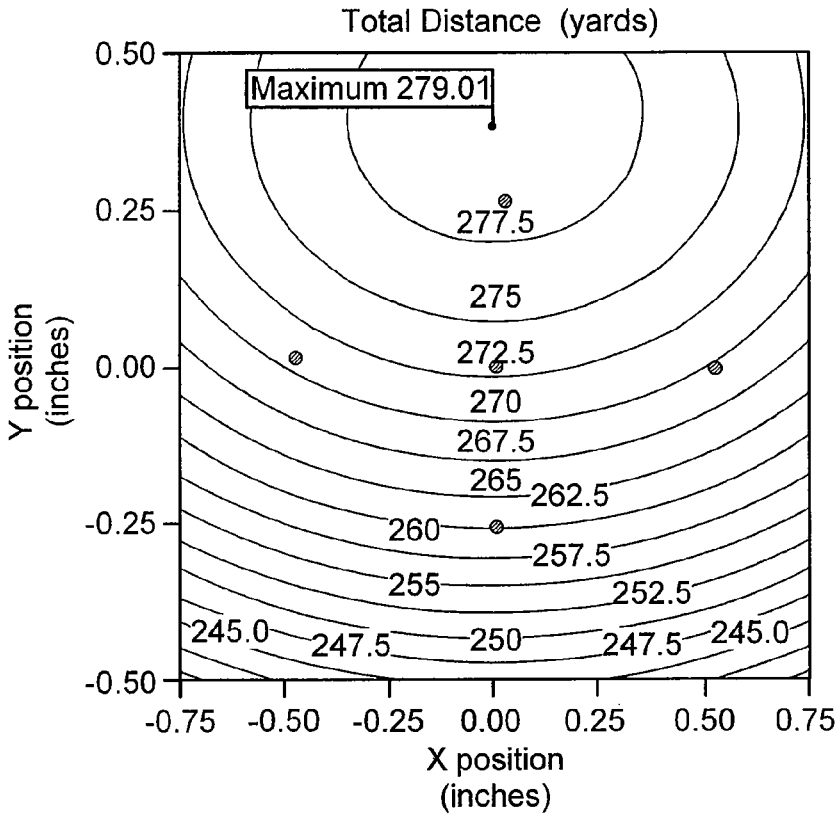
FIG. 20 (prior art)
FIG. 20 is a graph showing ball distance at positions on the front face of the prior art 983K.
Figure 21:
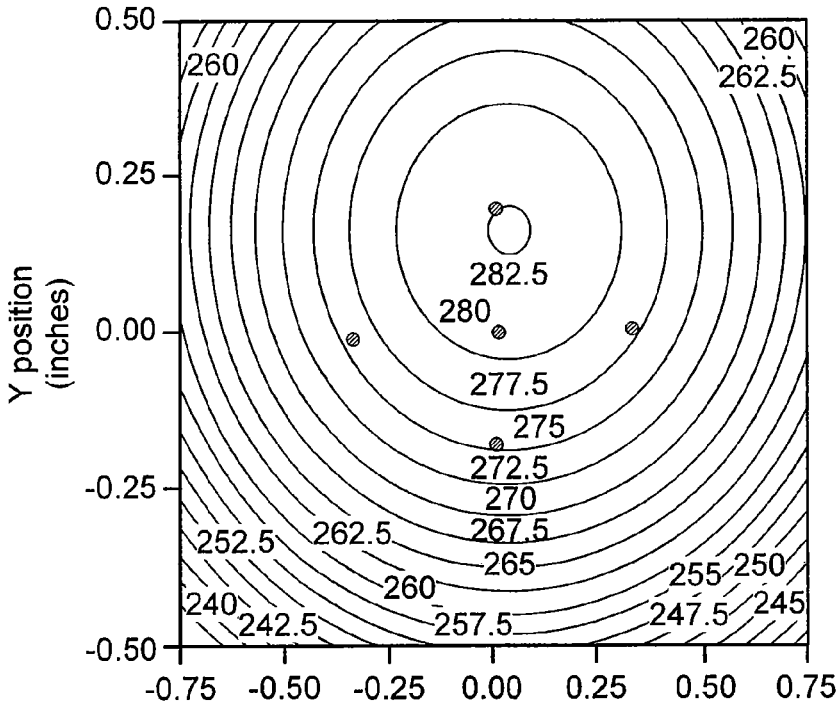
FIG. 21 is a graph showing ball distance at positions on the front face of the present invention.

The final results are culminated in FIGS. 20 and 21. With data taken at the geometric center for both club heads, FIG. 21 shows the club head of the present invention achieving an increase of almost 7.5 yards over that of the prior art.

These figures depict the initial ball speeds when the clubs traveling at about 110 mph impact Titleist PRO V1 ® balls. The angle of attack is about 2°, and the effective loft angle is about 12°. The clubs are mounted on a robot, which is driven to impact the balls at the desired club speed. Robots are commercially available from the True Temper Corporation or the Wilson® Sporting Goods Co. The locations of ball impacts are distributed over a rectangular area of 0.50 inch in the vertical direction and about 1.0 inch in the horizontal direction. The mechanical driver has the ability to repeatedly hit the balls at any desirable location on the hitting face. The ball speeds are measured by launch monitors. Any suitable launch monitor can be used. Examples of launch monitors include those described in commonly owned U.S. Pat. Nos. 6,533,674, 6,500,073, 6,488,591, 6,285,445, 6,241,622, 5,803,823 and 5,471,383, among others.

Figure 13A:
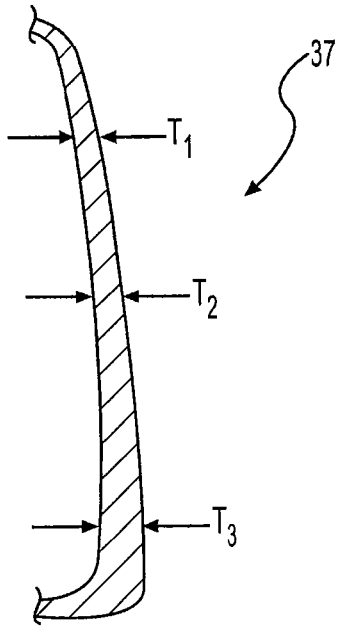
FIG. 13*a* is a side view of the variable thickness front face of the present invention.

Preferably, the front face section 37 of the present invention has a gradient thickness in the hitting face 48 ranging from the thinnest thickness about the crown section 34 to the thickest at the sole section 36. FIG. 13*a* depicts the preferred front face section 37, as including a machined face insert, and wherein $T_1$, of the upper portion near the crown section 34 can be as thin as about 0.08 inch (2.03 mm), the thickness $T_2$, at the middle section is about 3 mm, and the lower portion nearer to the sole section 36 has a thickness $T_3$ of about 0.20 inch (5.0 mm). This thickening of the lower region of the hitting face 48 causes an upward shift of the point of maximum coefficient of restitution (COR) to a position not lower than 2 mm below the geometric face center X and preferably about equal to the face center X. The club head 30 has a COR of at least 0.80 under test conditions, such as those specified by the USGA.

Figure 5:
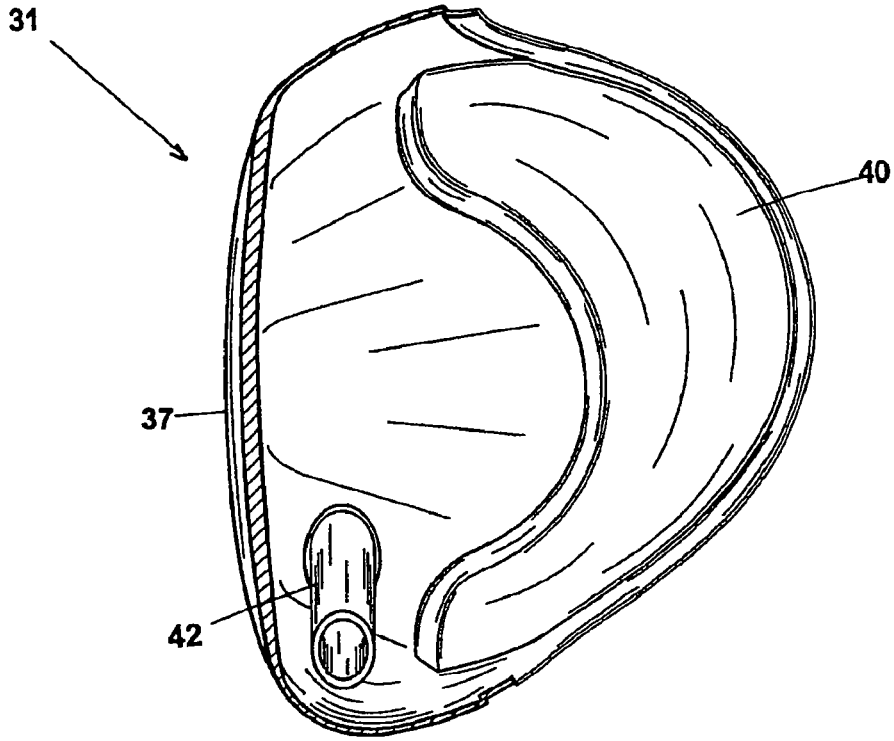
FIG. 5 is a cut out top view taken along line A-A of FIG. 8.
Figure 6:
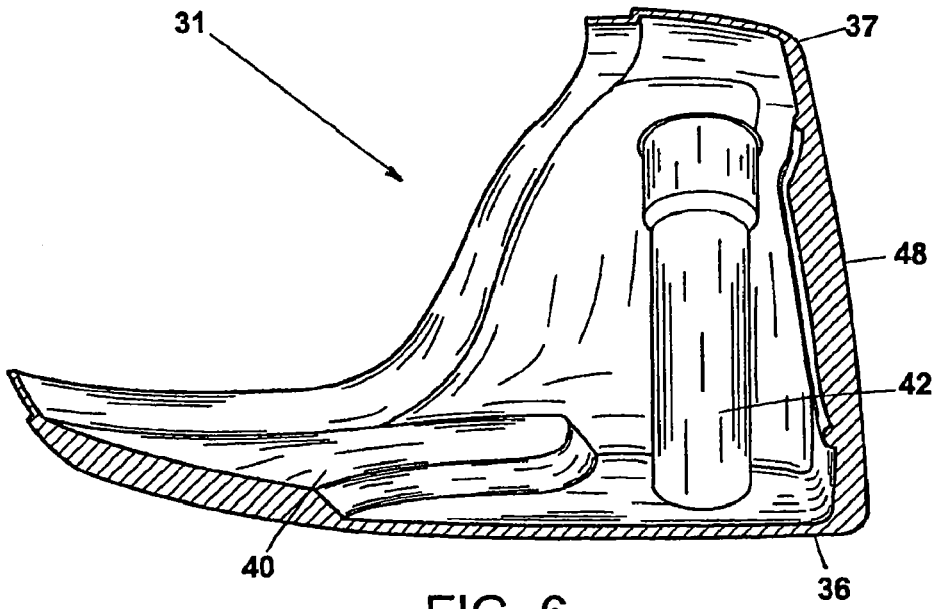
FIG. 6 is a partial cross-sectional view showing the bore-thru hosel tube and weight member.
Figure 7:
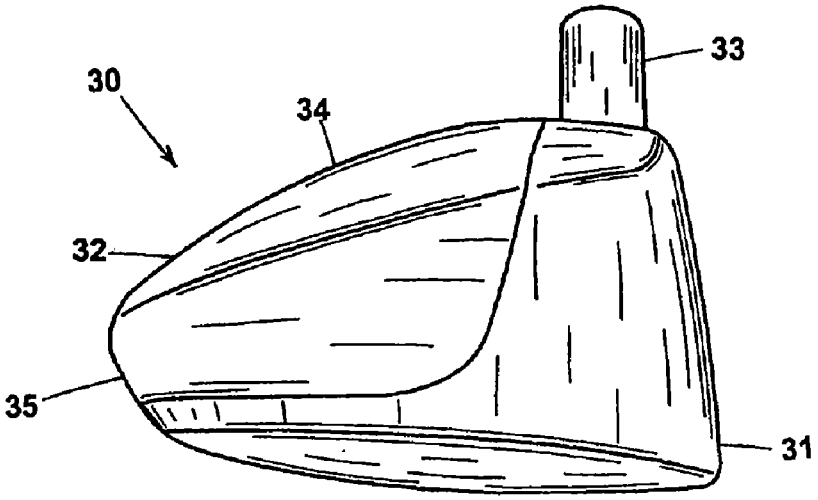
FIG. 7 is a toe view of FIG. 3 thereof.
Figure 8:
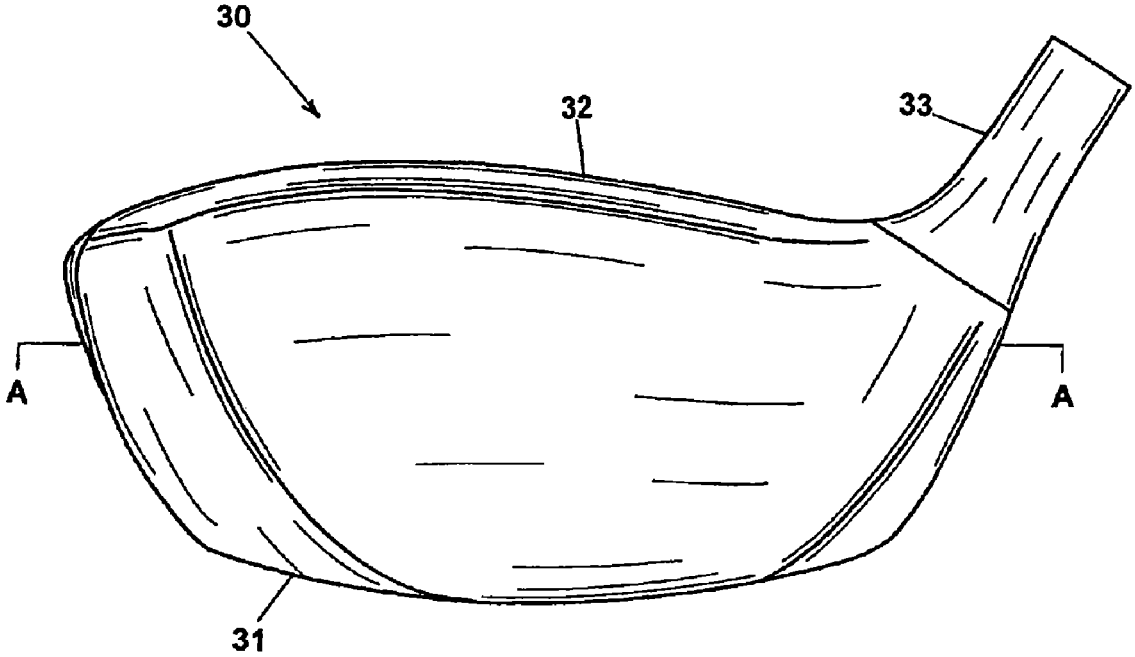
FIG. 8 is a front view of FIG. 3 thereof.
Figure 9:
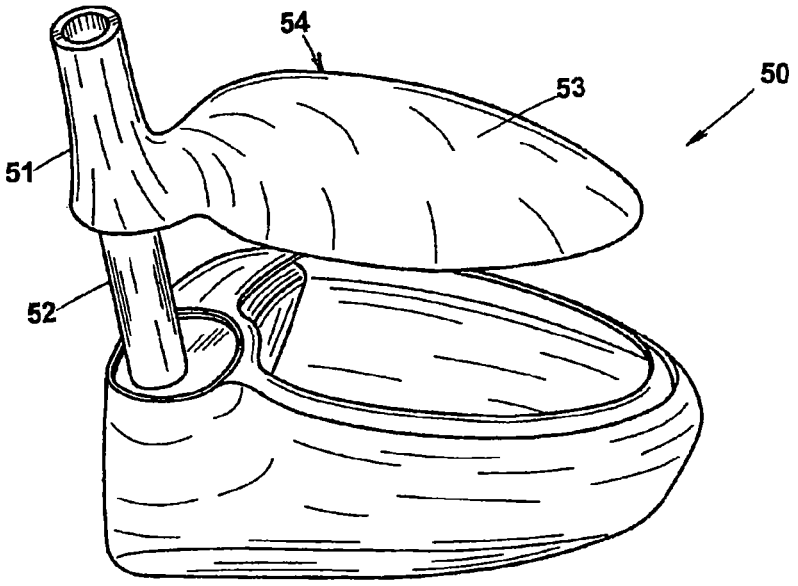
FIG. 9 is an expanded pictorial view of another embodiment of the invention. having two body portions.
Figure 10:
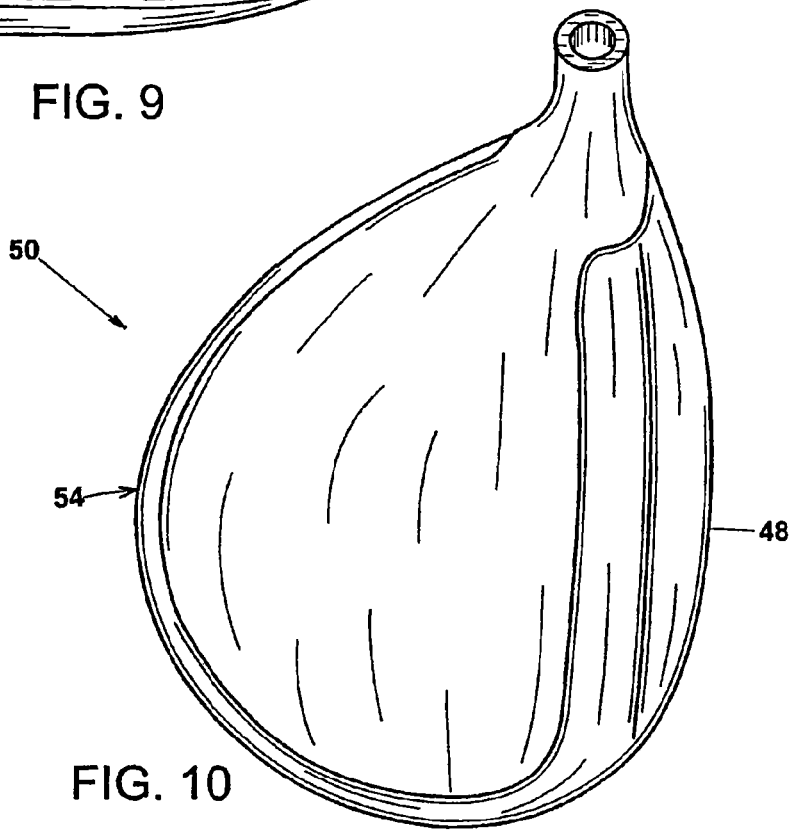
FIG. 10 is a top view of FIG. 9 thereof.
Figure 11:
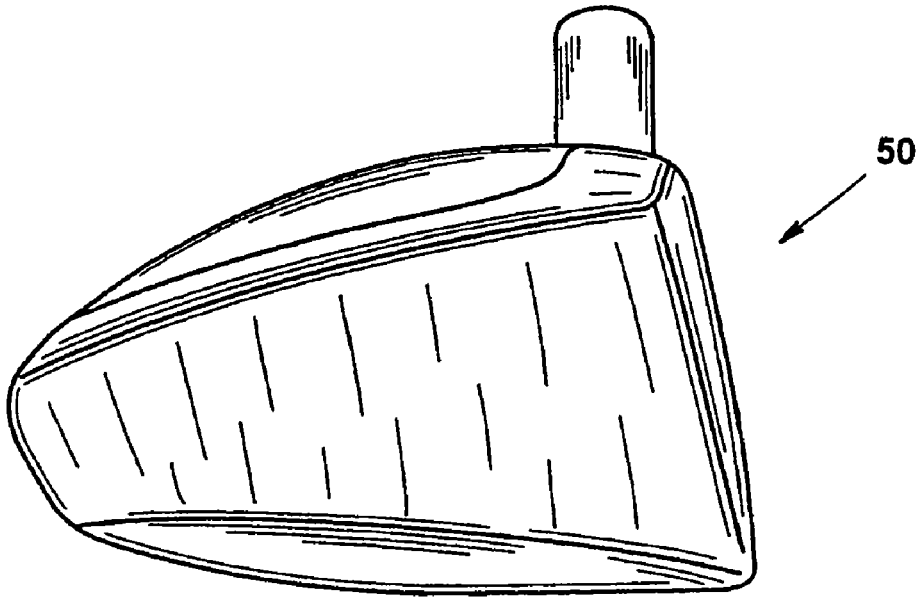
FIG. 11 is a toe view of FIG. 9 thereof.
Figure 12:
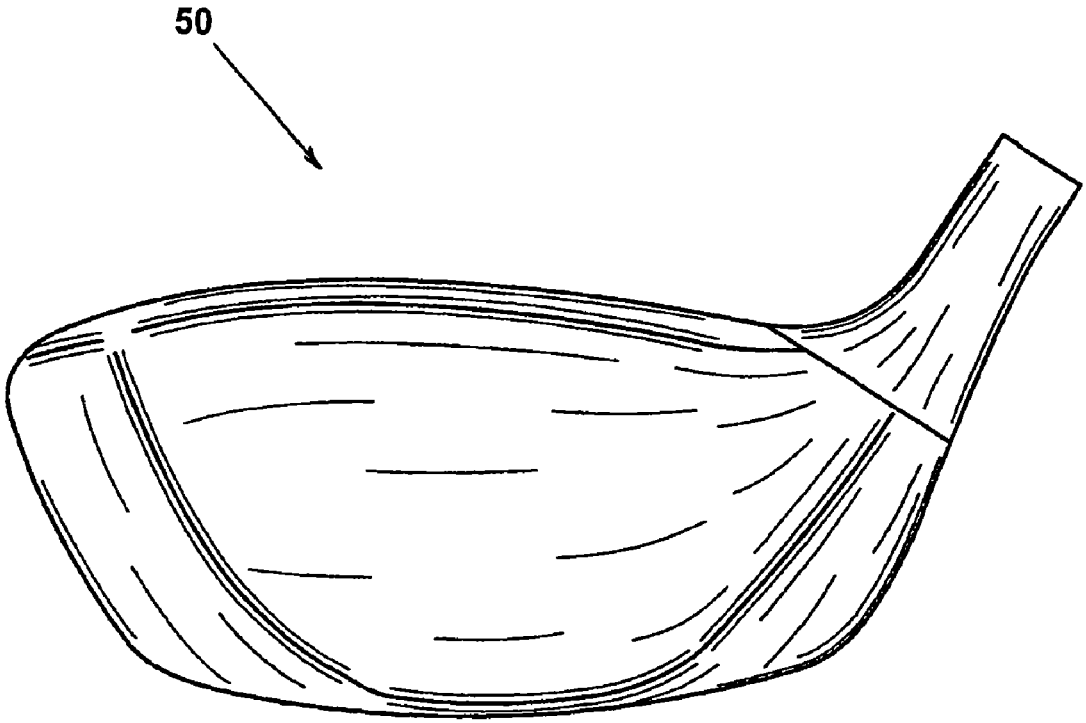
FIG. 12 is a front view of FIG. 9 thereof
Figure 13B:
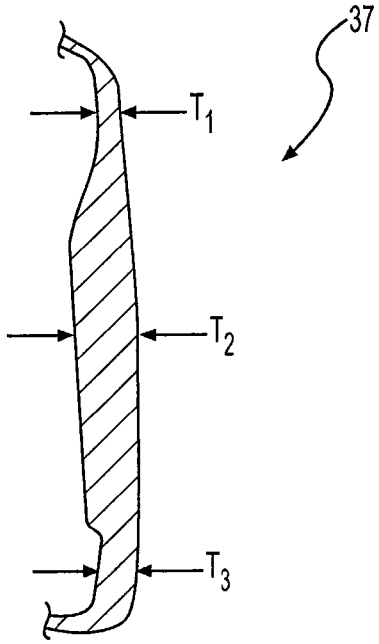
FIG. 13*b* is a side view of the variable thickness front face of an alternate embodiment.

An alternate embodiment for the front face section 37 is shown in FIG. 13*b*, 5 wherein the face insert is of a constant thickness in the T2 area and varied T1 and T3 areas, with the thinnest thickness at the crown area. Not shown is another alternative front face section wherein the insert area thickness T2 is varied and the thickness of sections depicted by T1 and T3 are constant.

The standard USGA conditions for measuring the coefficient of restitution is set forth in the *USGA Procedure for measuring the Velocity Ration of a Club Head for Conformance to Rule* 4-*le, Appendix II. Revision I, Aug.* 4, 1998 *and Revision* 0*, Jul.* 6, 1998, available from the USGA. Such tests measure COR by measuring ball resiliency. COR is the ratio of the velocity of separation to the velocity of approach. In this model, therefore, COR was determined using the following formula:

$$(v_{club\text{-}post}-v_{ball\text{-}post})/(v_{ball\text{-}pre}-v_{club\text{-}pre})$$

where:

$V_{club\text{-}post}$ represents the velocity of the club after impact;

$V_{ball\text{-}post}$ represents the velocity of the ball after impact;

$V_{club\text{-}pre}$ represents the velocity of the club before impact (a value of zero for USGA COR conditions); and $V_{ball\text{-}pre}$ represents the velocity of the ball before impact.

The COR, in general, depends on the shape and material properties of the colliding bodies. A perfectly elastic impact has a COR of one (1.0), indicating that no energy is lost, while a perfectly inelastic or perfectly plastic impact has a COR of zero (0.0), indicating that the colliding bodies did not separate after impact resulting in a maximum loss of energy. Consequently, high COR values are indicative of greater ball velocity and distance.

First and second body portions, 31, 32 and hosel member 33, are sized and dimensioned to be attached together by any conventional methods used to join dissimilar materials, such as brazing and structural adhesives. A high quality plasma welding technique, similar to the welding technique used in Titleist® 983 driver club, is preferred.

An alternate embodiment, depicted by FIGS. 9-12, and referred to as club head 50, illustrates the advantage of injection molding the second body portion, wherein a hosel section 51 and bore-thru-hosel tube 52 are integrated with a crown section 53 to form a crown portion 54. The advantage is that even more of the "high section" of the club head is made from a low density material (compared to the club head of embodiment 30 where bore-thru is made of higher density material). This allows for further lowering of the center of gravity C. The challenge is that the hosel is typically less rigid when made of low density material. Conventional golf clubs typically include a hosel welded on to the body of the club, which requires more manufacturing time and increases the complexity of manufacturing.

Alternatively, the club head of the present invention may also be used with the smaller fairway woods, which can have volume as low as about 150 cubic centimeters. Preferably, the mass of the inventive club head is greater than 150 grams but less than 300 grams. It is anticipated that a fairway wood may be made from the design concepts of the present invention. Such a wood may have a first body portion made of a metal such as stainless steel, a second body portion (substantially the crown and skirt) made from a lower density metal such as titanium, and a hosel member having a density no greater than the second body portion.

Another feature of the present invention includes the use of an insert positioned on an inner surface of the face opposite the strike surface. The insert may be used to stiffen the lower portion (that is, a portion located at or towards the sole) of the strike face, lowering the face COR. Restricting the COR of the lower portion of the strike face beneficially shifts the "compliant zone" or "sweet zone" of the face upward toward the crown. In other words, the point of maximum COR on the strike face is shifted upward such that it is between the crown and the geometric center of the face. The face has a COR between the sole and the geometric center (of the face) that is substantially less than the COR between the crown and the geometric center. Providing a face that is stiffer near the sole and progressively less stiff approaching the crown produces a higher launching, lower spinning trajectory of a struck golf ball, producing additional distance to the golf shot. The acoustics and feel of the golf club may also be improved. The insert creates a preferred striking zone located on the upper half of the face, the zone having a greater COR range than the rest of the face.

Forming the COR lowering insert of a light-weight material allows the face to be selectively reinforced and stiffened without adding significant weight to the club head. Similarly, the face can be of substantially uniform thickness rather than the gradient design discussed previously, freeing up additional weight. As used herein, "of substantially uniform thickness" means of uniform thickness within typical manufacturing and machining tolerances. This weight savings can be used advantageously by the club designer to optimize the center of gravity location, such as by adding weight members, without altering the overall weight of the club head. The club will thus not feel abnormally heavy to the golfer. Preferred exemplary materials contemplated for forming the insert include composites, resin systems, thermoset materials, thermoplastic materials, pitch based carbon fibers, PAN based carbon fibers, Kevlar® fibers, fiberglass fibers, spectra fibers, or combinations thereof. Similar light-weight materials may also be used. Composite materials have a lower density when compared to homogeneous materials such as titanium, steel, and other alloys, yet can stiffen the face due to their higher tensile modulus.

Figure 22:
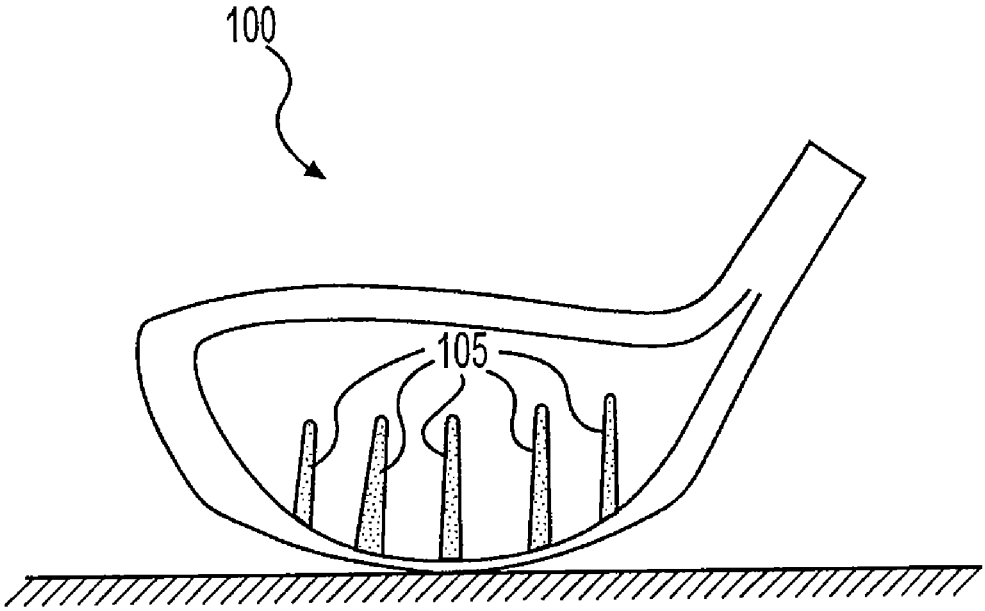
FIG. 22 shows a front view of another embodiment of a golf club head of the present invention including a stiffening insert.
Figure 23:
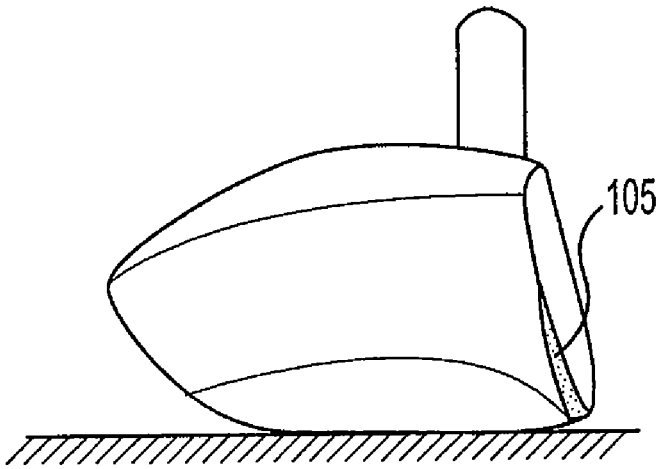
FIG. 23 shows a side view of the golf club head of FIG. 22.

FIG. 22 shows a face view of a first embodiment of a club head 100 with a stiffening insert 105, and FIG. 23 shows a toe-side view of this embodiment. The club head 100 includes a face, a crown, a sole, and a skirt coupled together to form a club head body having an interior volume. In this embodiment, the insert 105 is provided in the form of ribs. The ribs are attached to the inner surface of the face, within the interior volume. The ribs are spaced apart, preferably at regular intervals, and are oriented vertically in a sole-to-crown direction. While five ribs are shown in the illustrated embodiment, any number of ribs may be used. Three to seven ribs are preferred. Each of the ribs is wider at the sole end than at the crown end, thereby imparting more stiffness to the sole end of the face than the crown end. It should be noted that the ribs can extend from the sole all the way to the crown, or they may extend only partially up the face and not reach the crown. The ribs are wider at a sole end than at a crown end. The width of the ribs preferably may be from approximately 0.1 inch to approximately 0.15 inch wide at the sole end and gradually reduce in width approaching the crown end.

Figure 25:
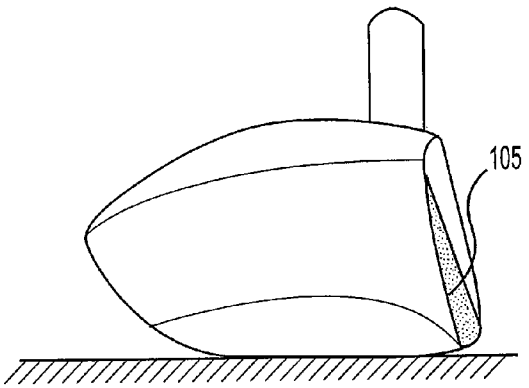
FIG. 25 shows a side view of the golf club head of FIG. 24.
Figure 24:
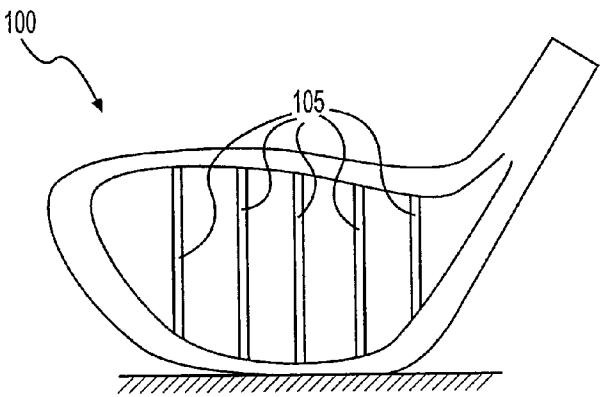
FIG. 24 shows a front view of another embodiment of a golf club head of the present invention including a stiffening insert.

FIG. 24 shows a face view of another embodiment of a club head 100 with a stiffening insert 105, and FIG. 25 shows a toe-side view of this embodiment. Similarly to the previous embodiment, the stiffening insert takes the form of ribs attached to the inner surface of the face, oriented vertically in a sole-to-crown direction. Here, however, the ribs vary in thickness, rather than in width, from the sole to the crown. In these FIGURES, the ribs are illustrated as extending from the sole all the way to the crown, though they could also extend only partially up the face. The ribs are thickest toward the sole and thinnest toward the crown. In a preferred design, each of the ribs is from approximately 0.1 inch to approximately 0.15 inch thick at the sole end and gradually reduce in thickness to the crown end. Five ribs are illustrated merely for exemplary purposes. Ribs that decrease in both width and thickness from the sole towards the crown may also be used to stiffen selective portions of the face.

Figure 27:
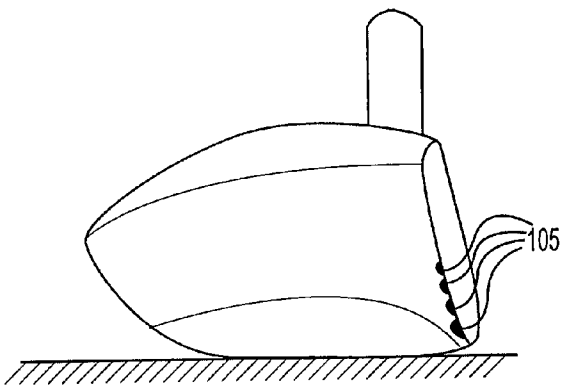
FIG. 27 shows a side view of the golf club head of FIG. 26.
Figure 26:
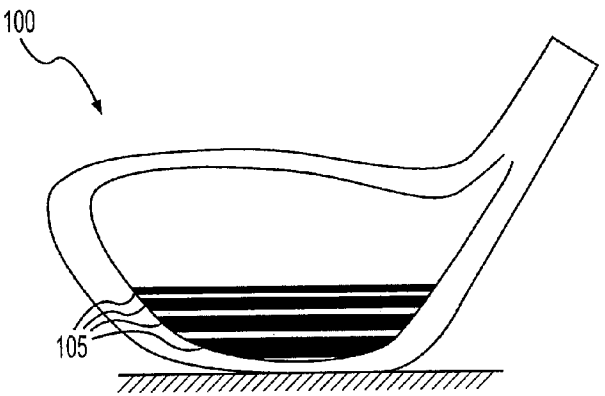
FIG. 26 shows a front view of another embodiment of a golf club head of the present invention including a stiffening insert.

FIG. 26 shows a face view of another embodiment of a club head 100 with a stiffening insert 105, and FIG. 27 shows a toe-side view of this embodiment. Here, again, the stiffening insert takes the form of ribs attached to the inner surface of the face. This time, however, the ribs are oriented horizontally in a toe-to-heel direction. As shown, the ribs decrease in thickness from the sole towards the crown. The rib nearest the sole has the greatest thickness, and the rib nearest the crown has the least thickness. Exemplary dimensions include from approximately 0.22 inch to approximately 0.18 inch thick for the rib nearest the sole and from approximately 0.022 inch to approximately 0.018 inch thick for the rib nearest the crown. The ribs can extend completely across the face from the toe to the heel, or, alternatively, only across a portion of the inner face surface.

Vertical ribs and horizontal ribs may be used in combination within a single club head. More mass, whether by being thicker or wider or both, is provided at the sole, and less is provided toward the crown. More mass yields greater stiffening forces applied to the face, and greater stiffness means less COR. The maximum COR is thus shifted upward towards the crown. For example, the lower (stiffer) half of a club head incorporating this aspect of the invention may have an average COR of 0.82 or less, while the upper (more compliant) half of the face has the maximum COR allowed by the governing bodies of golf. Currently, this limit is 0.83.

Figure 28:
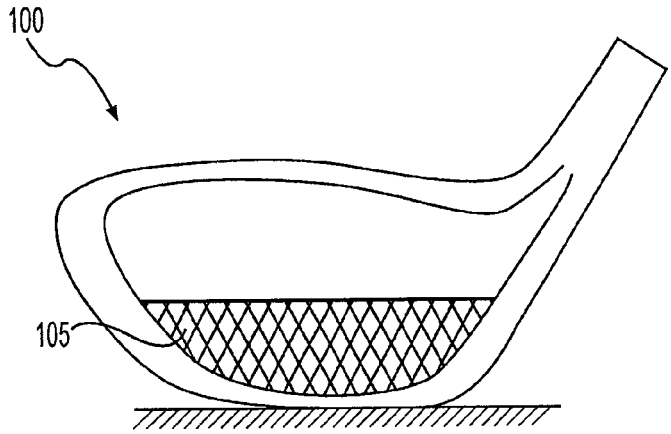
FIG. 28 shows a front view of another embodiment of a golf club head of the present invention including a stiffening insert.
Figure 29:
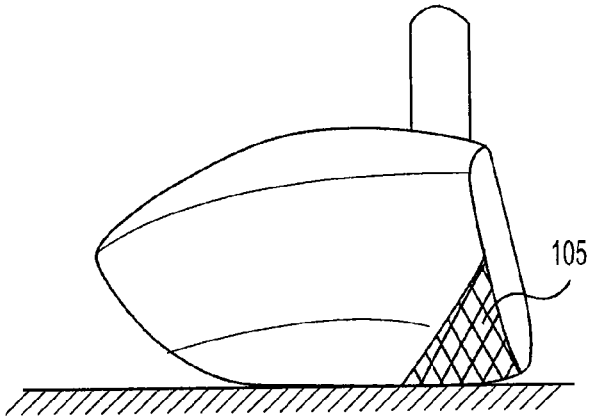
FIG. 29 shows a side view of the golf club head of FIG. 28.
Figure 30:
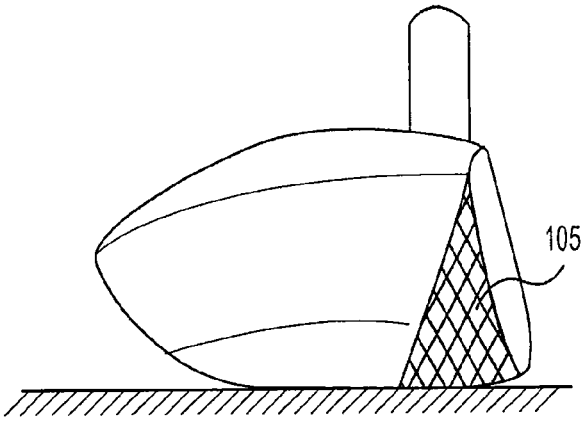
FIG. 30 shows a side view of another embodiment of a golf club head of the present invention.

FIG. 28 shows a face view of another embodiment of a club head 100 with a stiffening insert 105, and FIG. 29 shows a toe-side view of this embodiment. Rather than being in the form of ribs, here the stiffening insert is provided in the form of a patch coupled to the inner surface of the face. The patch is coupled adjacent the sole and extends upward toward the crown. In the embodiment illustrated in FIGS. 28 and 29, the patch does not extend all the way to the crown. FIG. 30 shows a toe-side view of a similar embodiment, but with the patch extending all the way to the crown. The patch has a tapered thickness, being thickest at a lower portion adjacent the sole and thinnest at an upper portion toward the crown and away from the sole. As previously discussed, the increased mass and thickness towards the sole imparts more stiffening to the lower portion of the club face and shifts the compliant or sweet zone upward, preferably above the geometric center of the face. Providing the stiffening means in the form of a patch facilitates attaching the insert to the inner surface of the club head.

The stiffening insert, regardless of its form, may be attached to the face prior to its attachment to the club head body. Alternatively, the face may first be coupled to the body and then the insert attached thereto, such as through an opening in the crown over which a crown insert is later attached. Bonding or adhering are preferred for attaching the insert to the face. The stiffening insert creates a face having a non-uniform COR to achieve more desired ball performance in use. The insert is attached to a portion of the face inner surface, stiffens the face in and around the area of attachment, lowering the COR thereof below a predetermined value, and shifting the compliant portion upward, preferably above the geometric center of the face.

While various descriptions of the present invention are described above, it should be understood that the various features of each embodiment could be used alone or in any combination thereof. Therefore, this invention is not to be limited to only the specifically preferred embodiments depicted herein. Further, it should be understood that variations and modifications within the spirit and scope of the invention might occur to those skilled in the art to which the invention pertains. The scope of the present invention is accordingly defined as set forth in the appended claims.

What is claimed is:

1. A golf club head, comprising:

a face, a crown, a sole, and a skirt coupled together to form a club head body having an interior volume, wherein the face has a striking surface and an inner surface opposite the striking surface; and a patch coupled to the inner surface of the face within the interior volume, wherein the patch comprises a material selected from the group consisting of composites, resin systems, thermoset materials, thermoplastic materials, pitch based carbon fibers, PAN based carbon fibers, para-aramid fibers, fiberglass fibers, spectra fibers, or combinations thereof, wherein the patch extends across the inner surface from toe to heel, wherein the patch has a first thickness at a lower portion adjacent the sole and a second thickness at an upper portion, wherein the first thickness is greater than the second thickness, and wherein the face has a point of maximum coefficient of restitution between the crown and a geometric center of the face.

2. The golf club head of claim 1, wherein the face has a coefficient of restitution between the sole and the geometric center of the face that is substantially less than the point of maximum coefficient of restitution between the crown and the geometric center of the face.

3. The golf club head of claim 1, wherein the patch is coupled adjacent the sole and extends upward toward the crown.

4. The golf club head of claim 3, wherein the patch does not extend all the way to the crown.

5. The golf club head of claim 3, wherein the patch extends all the way to the crown.

6. The golf club head of claim 1, wherein the face is of substantially uniform thickness.

7. The golf club head of claim 1, wherein the patch extends from the heel to the toe of the club head.

8. A golf club head, comprising:

a face, a crown, a sole, and a skirt coupled together to form a club head body having an interior volume, wherein the face has a striking surface and an inner surface opposite the striking surface; and a patch coupled to the inner surface of the face within the interior volume, wherein the patch comprises a material selected from the group consisting of composites, resin systems, thermoset materials, thermoplastic materials, pitch based carbon fibers, PAN based carbon fibers, para-aramid fibers, fiberglass fibers, spectra fibers, or combinations thereof, wherein the patch has a tapered thickness that is thickest at a lower portion adjacent the sole and thinnest at an upper portion away from the sole, and wherein the face has a first coefficient of restitution between the crown and a geometric center of the face and a second coefficient of restitution between the sole and the geometric center of the face, wherein the second coefficient of restitution is less than the first coefficient of restitution.

9. The golf club head of claim 8, wherein:

the patch is coupled to the inner surface adjacent the sole and extends upward toward the crown.

10. The golf club head of claim 9, wherein the patch does not extend all the way to the crown.

11. The golf club head of claim 9, wherein the patch extends all the way to the crown.

12. The golf club head of claim 8, wherein the face is of substantially uniform thickness.

13. The golf club head of claim 8, wherein the face has a point of maximum coefficient of restitution between the crown and a geometric center of the face.

14. The golf club head of claim 8, wherein the patch extends from the heel to the toe of the club head.

15. A golf club head, comprising:

a face, a crown, a sole, and a skirt coupled together to form a club head body having an interior volume, wherein the face has a striking surface and an inner surface opposite the striking surface; and a patch coupled to the inner surface of the face within the interior volume, wherein the patch comprises a material selected from the group consisting of composites, resin systems, thermoset materials, thermoplastic materials, pitch based carbon fibers, PAN based carbon fibers, para-aramid fibers, fiberglass fibers, spectra fibers, or combinations thereof, wherein the patch has a first thickness at a lower portion adjacent the sole and a second thickness at an upper portion, wherein the first thickness is greater than the second thickness, and wherein the patch creates a preferred striking zone on the face, wherein the preferred striking zone is located on an upper half of the striking surface and has a greater coefficient of restitution range than the rest of the face.

16. The golf club head of claim 15, wherein the patch is coupled adjacent the sole and extends upward toward the crown.

17. The golf club head of claim 16, wherein the patch does not extend all the way to the crown.

18. The golf club head of claim 16, wherein the patch extends all the way to the crown.

19. The golf club head of claim 15, wherein the face has a substantially uniform thickness.

20. A golf club head, comprising:

a face, a crown, a sole, and a skirt coupled together to form a club head body having an interior volume, wherein the face has a striking surface and an inner surface opposite the striking surface; and a patch coupled to the inner surface, wherein the patch has a first thickness at a lower portion adjacent the sole and a second thickness at an upper portion, wherein the first thickness is greater than the second thickness, wherein the face has a substantially uniform thickness, wherein the face has a point of maximum coefficient of restitution above the geometric center of the face, and wherein an area on the face between the sole and the geometric center has a coefficient of restitution that is less than the point of maximum coefficient of restitution.

21. The golf club head of claim 20, wherein the patch is coupled adjacent the sole and extends upward toward the crown.

22. The golf club head of claim 21, wherein the patch extends to the crown.

* * * * *

UNITED STATES PATENT AND TRADEMARK OFFICE

CERTIFICATE OF CORRECTION

PATENT NO. : 8,353,787 B2
APPLICATION NO. : 12/633960
DATED : January 15, 2013
INVENTOR(S) : Jeffrey W. Meyer et al.

It is certified that error appears in the above-identified patent and that said Letters Patent is hereby corrected as shown below:

On the title page under Item (60) "Related U.S. Application Data", the data should be corrected to reflect as follows:

This application is a continuation of application No. 11/192,112, filed on Jul. 29, 2005, now Pat. No. 7,651,412, which is a continuation-in-part of application No. 10/662,682, filed on Sep. 15, 2003, now abandoned.

Signed and Sealed this
Ninth Day of April, 2013

Teresa Stanek Rea

Teresa Stanek Rea
*Acting Director of the United States Patent and Trademark Office*